United States Patent [19]

Novikoff

[11] 4,118,693

[45] Oct. 3, 1978

[54] METHOD AND APPARATUS FOR PRODUCING UNIFORM ELECTROMAGNETIC FIELDS IN AN ARTICLE DETECTION SYSTEM

[75] Inventor: Eugene B. Novikoff, Woodbury, N.Y.

[73] Assignee: Knogo Corporation, Hicksville, N.Y.

[21] Appl. No.: 795,132

[22] Filed: May 9, 1977

[51] Int. Cl.[2] ..... G08B 13/24

[52] U.S. Cl. ..... 340/572

[58] Field of Search ..... 340/280, 258 C

[56] References Cited

U.S. PATENT DOCUMENTS

| | | | |
|---|---|---|---|
| 3,500,373 | 3/1970 | Minasy | 340/280 |
| 3,707,711 | 12/1971 | Cole et al. | 340/280 |
| 3,838,409 | 9/1974 | Minasy et al. | 340/280 |
| 3,983,552 | 9/1976 | Bakeman, Jr. et al. | 340/258 C |

FOREIGN PATENT DOCUMENTS

| | | | |
|---|---|---|---|
| 763,681 | 2/1934 | France | 340/280 |

*Primary Examiner*—Glen R. Swann, III

*Attorney, Agent, or Firm*—Fitzpatrick, Cella, Harper & Scinto

[57] ABSTRACT

An electromagnetic article detection system of the type wherein a target having frequency selective electrical characteristics produces predetermined electromagnetic effects in response to an alternating electromagnetic field. A large resonant electric circuit is placed across an interrogation zone from an interrogation antenna and is inductively coupled to the interrogation antenna to generate secondary electromagnetic waves which cooperate with the primary electromagnetic waves from the interrogation antenna to provide improved distribution of electromagnetic field strength in the interrogation zone.

21 Claims, 4 Drawing Figures

METHOD AND APPARATUS FOR PRODUCING UNIFORM ELECTROMAGNETIC FIELDS IN AN ARTICLE DETECTION SYSTEM

BACKGROUND OF THE INVENTION

1. Field of the Invention

This invention relates to electromagnetic detection systems and more particularly it concerns novel arrangements which provide improved performance from such systems.

2. Description of the Prior Art

French Pat. No. 763,681 issued on Feb. 19, 1934 to Pierre Arthur Picard shows one type of electromagnetic detection system upon which the present invention provides improvements. As disclosed in that patent, an article to be detected, e.g., a library book, is provided with a target or marker of a special saturable magnetic material, such as permalloy. A large coil is arranged near a doorway or other egress passageway leading from the area where the article to be detected is kept. This coil is energized with an alternating electrical signal so that it produces a corresponding alternating interrogation magnetic field in an interrogration zone in the region of the doorway. When the book bearing the permalloy marker passes through the alternating interrogation magnetic field, as when it is carried out through the doorway, the permalloy marker converts a portion of the alternating interrogation magnetic field energy to other alternating magnetic fields at various harmonics of the frequency of the fundamental or interrogation magnetic field. Selected ones of these harmonics are detected in the receiver; and when these harmonics are detected an alarm is sounded.

Another prior art electromagnetic detection system is shown and described in U.S. Pat. No. 3,500,373. In that system electromagnetic waves are generated at swept frequencies in an interrogation zone and a target, comprising a resonant circuit tuned to one of the frequencies, causes electromagnetic disturbances which are detected.

SUMMARY OF THE INVENTION

The present invention provides improvements to electromagnetic detection systems of the aforementioned type.

According to the present invention there is provided a parasitic resonant coil positioned in the vicinity of the interrogation zone at a location displaced from the interrogation antenna which emits primary electromagnetic waves. The parasitic resonant circuit is tuned to resonate at the frequency of the primary waves. When the interrogation antenna is energized it becomes coupled, inductively, to the parasitic coil; and causes the parasitic circuit to resonate. This in turn causes secondary electromagnetic waves at the same frequency to be emitted from the parasitic antenna coil so that a more uniform intensity of interrogation signal is established throughout the interrogation zone. The parasitic circuit is energized solely by electromagnetic coupling with the interrogation antenna so that it is inherently maintained in perfect phase and frequency relationship to the primary waves from the interrogation antenna. These secondary waves from the parasitic circuit, moreover, are in 90° phase relationship to the primary waves from the interrogation antenna so that no cancellation results from the presence of these different waves.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the purposes of this invention. It is important, therefore, that this disclosure be regarded as including such equivalent arrangements as do not depart from the spirit and scope of the invention.

BRIEF DESCRIPTION OF THE DRAWINGS

Two embodiments of the invention have been chosen for purposes of illustration and description, and are shown in the accompanying drawings forming a part of the specification, wherein:

FIG. 2 is a perspective view of a book outfitted with a target or marker to enable it to be detected by the system of FIG. 1;

DETAILED DESCRIPTION OF THE PREFERRED EMBODIMENTS

Figure 1:
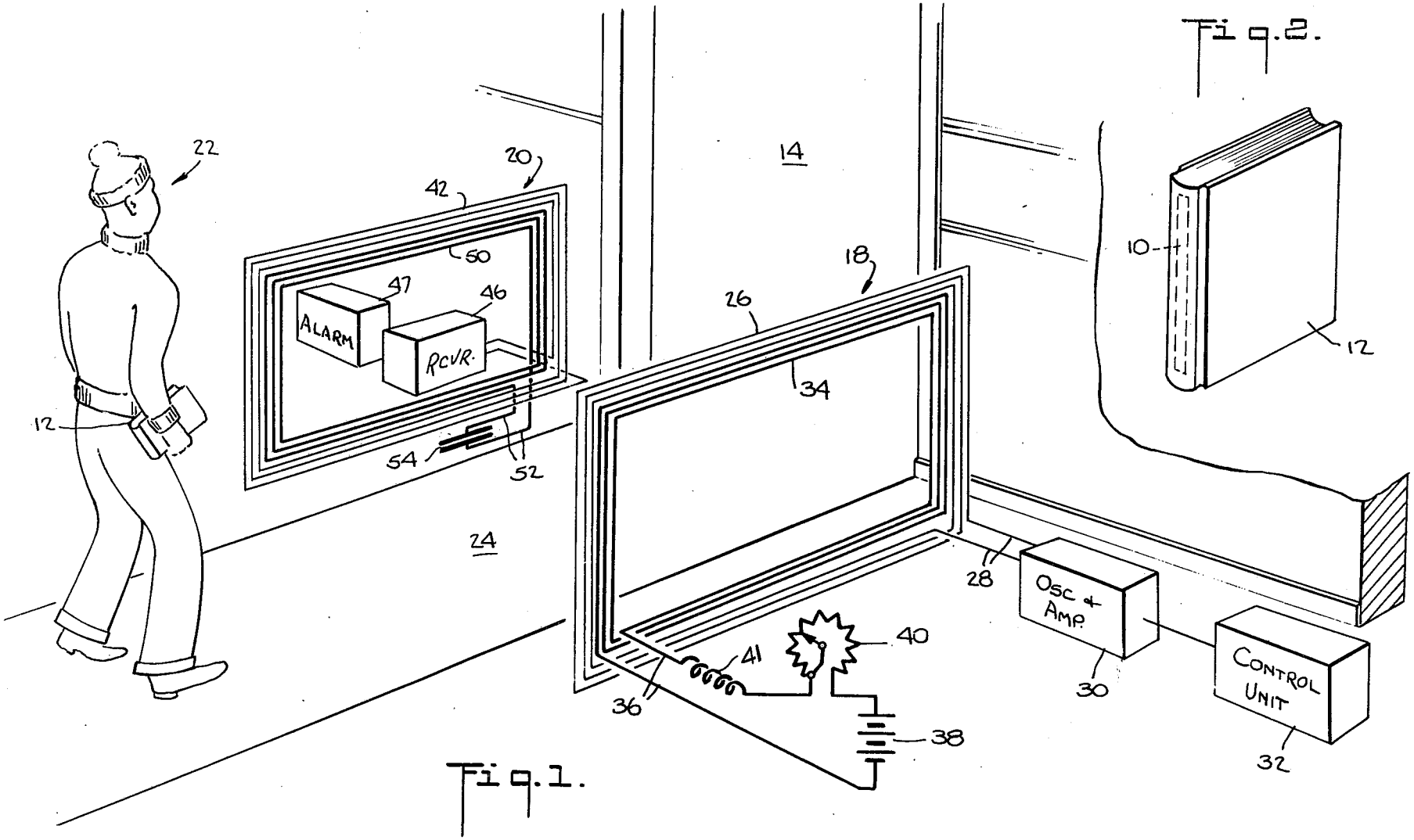
FIG. 1 is a perspective view, partially in schematic form, of an article detection system installation in which the present invention is embodied.

The article detection system installation of FIG. 1 may be located, for example, in a library to protect against the unauthorized removal of books, records, etc. from the library premises. In such case, the article to be protected is provided with a target or marker which comprises a thin elongated strip of easily saturable magnetic material such as permalloy. The target or marker, which may be hidden on the article to be protected may have a length of about 7 inches (18 cm.), a width of ⅛ inch (0.32 cm.) and a thickness of about one thousandth of an inch (0.025 mm.).

FIG. 2 illustrates the positioning of a target or marker 10 (shown in dotted outline) along the spine of a book 12 to protect it. Marker 10 is preferably of permalloy material as disclosed in the aforesaid French Pat. No. 763,681.

Reverting now to FIG. 1, there is shown a doorway 14 which forms an egress passageway from a protected area such as a library reading room 16. A pair of large antenna clusters, comprising a transmitting cluster 18 and a receiving cluster 20, are positioned in the reading room 16 adjacent to and on opposite sides of the doorway 14. The antenna clusters 18 and 20 are arranged in parallel planes; and when a patron, 22 exits from the reading room 16 through the doorway 14, he must pass between the antenna clusters 18 and 20. The region between the antenna clusters 18 and 20 constitutes an interrogation zone 24 and the electromagnetic effects produced by and on the system, as will be described hereinafter, take place primarily in the interrogation zone. Thus, when the book 12 carrying the marker 10 (FIG. 2) is carried by the patron 22 through the interrogation zone 24, the marker 10 will react electromagnetically with the detection system to produce an alarm;

however no interaction and no alarm will be produced when the targeted book is at other locations in the reading room 16 away from the interrogation zone 24, and no alarm will be produced when other article, which are not protected with a special target or marker, pass through the interrogation zone.

The transmitter antenna cluster 18 includes a flat, expansive, essentially rectangular interrogation coil 26 made up of several turns of insulated electrically conductive wire. Panel or support means (not shown) may be provided to hold the interrogation coil in place. The ends of the interrogation coil 26 are connected via leads 28 to an oscillator and amplifier 30; and this in turn is connected to be controlled by a control unit 32. The oscillator and amplifier serve to supply alternating electrical current of essentially single frequency to the interrogation coil 26. The present invention is not concerned with the details of this component and accordingly in the interest of clarity those details will not be described herein. Devices for supplying alternating electrical current to a coil are well known and one such device is described in the aforementioned French Pat. No. 763,681 to Picard. Similarly, the details of the control unit 32 are not essential to the present invention and in the interest of clarity these will not be described. Essentially the control unit 32 serves to turn the oscillator and amplifier on and off; for example, when the patron 22 approaches the interrogation zone 24 some switching means, such as a photoelectric system, or a pressure sensitive switch on the floor (not shown) may be activated by passage of the patron into the interrogation zone and the control unit 32 will respond to this switching means to turn on the oscillator and amplifier 30.

The transmitter antenna cluster 18 also includes a flat, essentially rectangular bias coil 34 also made up of several turns of insulated electrically conductive wire. The bias coil is of essentially the same size and shape as that of the interrogation coil 26 and it is mounted to nest within or lay against the interrogation coil 26. For purposes of illustration the bias coil 34 is shown to lie within the transmitter coil; however any arrangement which places the bias coil so that it closely follows the size, shape and location of the transmitter coil will suffice. The ends of the bias coil 34 are connected via leads 36 to a direct current bias source such as a battery 38 and to a current control device such as a rheostat 40 in series with the coil and battery. A linear choke coil 41 is arranged in series with the battery 38 to protect against circulation of alternating currents induced from the interrogation coil 26.

The receiving antenna cluster 20 is made up of a receiver coil 42 which may be similar in configuration to that of the interrogation and bias coils 26 and 34, but located on the opposite side of the interrogation zone 24 from those coils. The ends of the receiver coil 42 are connected via leads 44 to a receiver 46; and this in turn is connected to an alarm 47. The receiver 46 may be any device capable of detecting selected signals on the leads 44 which are produced by electromagnetic disturbances in the interrogation zone 24 acting on the receiver coil 42. More particularly, the receiver 46 is tuned to produce an output signal when the electromagnetic disturbances acting on the receiver coil 42 include frequencies which are at some one or more selected harmonics of the frequency of the oscillator and amplifier 30. The alarm 47 may be any device capable of producing an audio of visual output, such as the ringing of a bell or the lighting of a light, in response to outputs from the receiver 46. Means (not shown) may also be provided to lock a door or turnstile in the path of the interrogation zone when the receiver 46 produces an alarm actuating output.

The present invention does not rely upon the specific details of the receiver 46 and the alarm 47 and for purposes of simplicity and clarity those details have been omitted, suffice it to say that suitable receiver and alarm means are already described and shown in detail in the aforementioned French Pat. No. 763,681 to Picard.

A parasitic coil 50 of flat, expansive configuration, is shown to be positioned across the interrogation zone 24 from the interrogation antenna coil 26. The parasitic coil 50 is also made up of several turns of electrically conductive wire and it is essentially of the same size and shape as that of the interrogation antenna coil 26. For purposes of illustration the parasitic coil 50 is shown to lie adjacent to or nested with the receiver coil 42; however any arrangement which places the parasitic coil across from the interrogation antenna coil 26 will suffice. Preferably, the parasitic coil should be parallel to and aligned with the transmitter antenna coil. The ends of the parasitic coil 50 are connected via leads 52 across a capacitor 54 to form a resonant electrical circuit. While FIG. 1 diagramatically shows a single capacitor 54, it is to be understood that several capacitors may be connected in series or parallel with each other to provide a proper amount of capacitance for the circuit.

The capacitance of the capacitor 54 is chosen in accordance with the inductance of the parasitic coil 50 to form a resonant electrical circuit whose resonant frequency is equal to the frequency at which the interrogation oscillator and amplifier 30 drive the interrogation antenna coil 26. It will be noted that the resonant electrical circuit formed by the parasitic coil 50 and capacitor 54 is not connected either to the transmitter system or to the receiver system.

In operation of the detection system, the control unit 32 causes the oscillator and amplifier 30 to supply alternating electrical current to the interrogation coil 26 and this in turn produces alternating electromagnetic interrogation waves in the interrogation zone 24. These waves are referred to herein as the "primary interrogation waves." In the presently preferred system the frequency of the primary interrogation waves, i.e. the fundamental frequency, is 2.5 kilohertz. The receiver is not tuned to the fundamental 2.5 kilohertz frequency but instead it is tuned to some selected harmonic of that frequency, preferably an even harmonic such as the sixth (i.e. 15 kilohertz). Now when a patron 22 brings a protected article, such as the book 12 into the interrogation zone 24, the permalloy target 10 (FIG. 2) on the book will convert a portion of the energy of the alternating electromagnetic interrogation waves, which are incident upon it, to other alternating electromagnetic waves at frequencies which are harmonics of the fundamental frequency (2.5 kilohertz).

It has been found that a thin strip of permalloy will produce a much larger amplitude sixth harmonic under these conditions than other materials and accordingly by monitoring for signals at the sixth harmonic of the fundamental frequency it is possible to detect only those articles which have been specially marked or targeted with the permalloy strips. This sixth harmonic detection is achieved by providing appropriate frequency filtering means in association with the receiver coil 42 and the receiver 46. Such filtering means are well known and suitable means are shown and described in the above identified French Pat. No. 763,681 to Picard. When the receiver 46 detects the presence of electromagnetic waves at the sixth harmonic (i.e. 15 kilohertz) it sends a signal to the alarm 47 to actuate it and signal the presence of a book 12 or other article bearing an active marker 10.

The bias system comprising the bias coil 34 and the means for supplying direct current of predetermined value through the coil, serves to improve response of the target 10. The manner in which this takes place is described in detail in copending application Ser. No. 715,568 in the name of Eugene B. Novikoff and assigned to the assignee of the present invention.

The parasitic coil 50 and capacitor 54 of the present invention serve to provide a more uniform distribution of the electromagnetic interrogation waves throughout the interrogation region than is possible with only the interrogation antenna coil 26. This is accomplished by means of inductive coupling across the interrogation zone 24 between the interrogation and parasitic coils 26 and 50 which induces the current flow in the resonant circuit comprising the parasitic coil 50 and its capacitor 54. Since the coil 50 and capacitor 54 are chosen to resonate at the frequency at which the interrogation antenna coil 26 is energized, maximum coupling is achieved and a large current flow is induced in the parasitic circuit. This large current flow itself generates electromagnetic waves in the interrogation region. These electromagnetic waves which are emitted from the parasitic coil 50 are referred to herein as the "secondary interrogation waves." Since these secondary waves originate across the interrogation zone 24 from the interrogation antenna coil 26 they cooperate with the primary interrogation waves emitted directly from the interrogation antenna coil to make the distribution of electromagnetic field strength more uniform throughout the interrogation zone. Thus when a target 10 is on the receiver side of the interrogation zone 24 it receives minimum electromagnetic field strength directly from the interrogation antenna coil 26 but it receives maximum electromagnetic field strength from the parasitic antenna coil 50. Because of its large size and substantial coupling with the interrogation antenna coil 26, parasitic coil 50 can provide a large electromagnetic field even though it is not separately energized. This coupling is maximized when the parasitic coil 50 is about the same size and configuration as the interrogation antenna coil 26 and when it is parallel to and aligned with the interrogation antenna coil.

It has also been found that the secondary interrogation waves from the parasitic antenna coil 50 do not interfere with the primary interrogation waves generated by the interrogation antenna coil. This is because the secondary waves generated by the parasitic antenna coil 50 are precisely 90° out of phase with the primary waves generated by the interrogation antenna coil 26. Thus no wave cancellation occurs anywhere in the interrogation zone 24.

It will further be appreciated that since the secondary interrogation waves produced by the parasitic antenna coil 50 result from the coupling between the interrogation antenna coil 26 and the parasitic antenna coil 50, the waves emmanating from the two coils are precisely phase related and therefore no problem of drift or synchronization is encountered.

Figure 3:
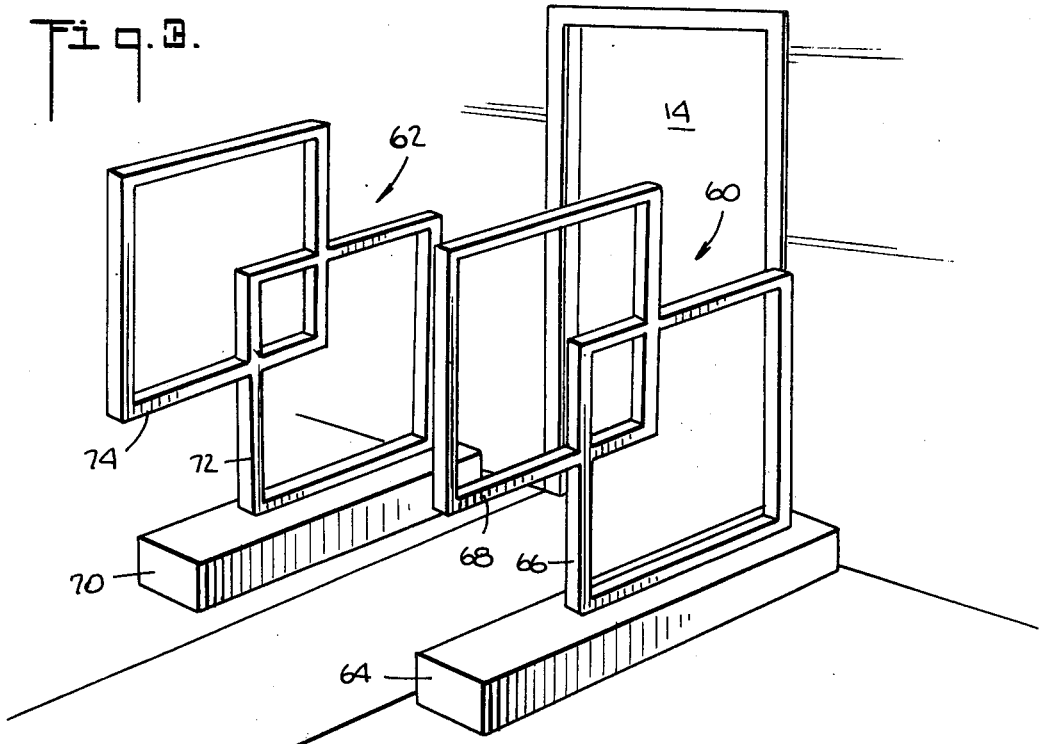
FIG. 3 is a perspective view similar to FIG. 1, but showing a presently preferred arrangement of antennas in the article detection system.
Figure 4:
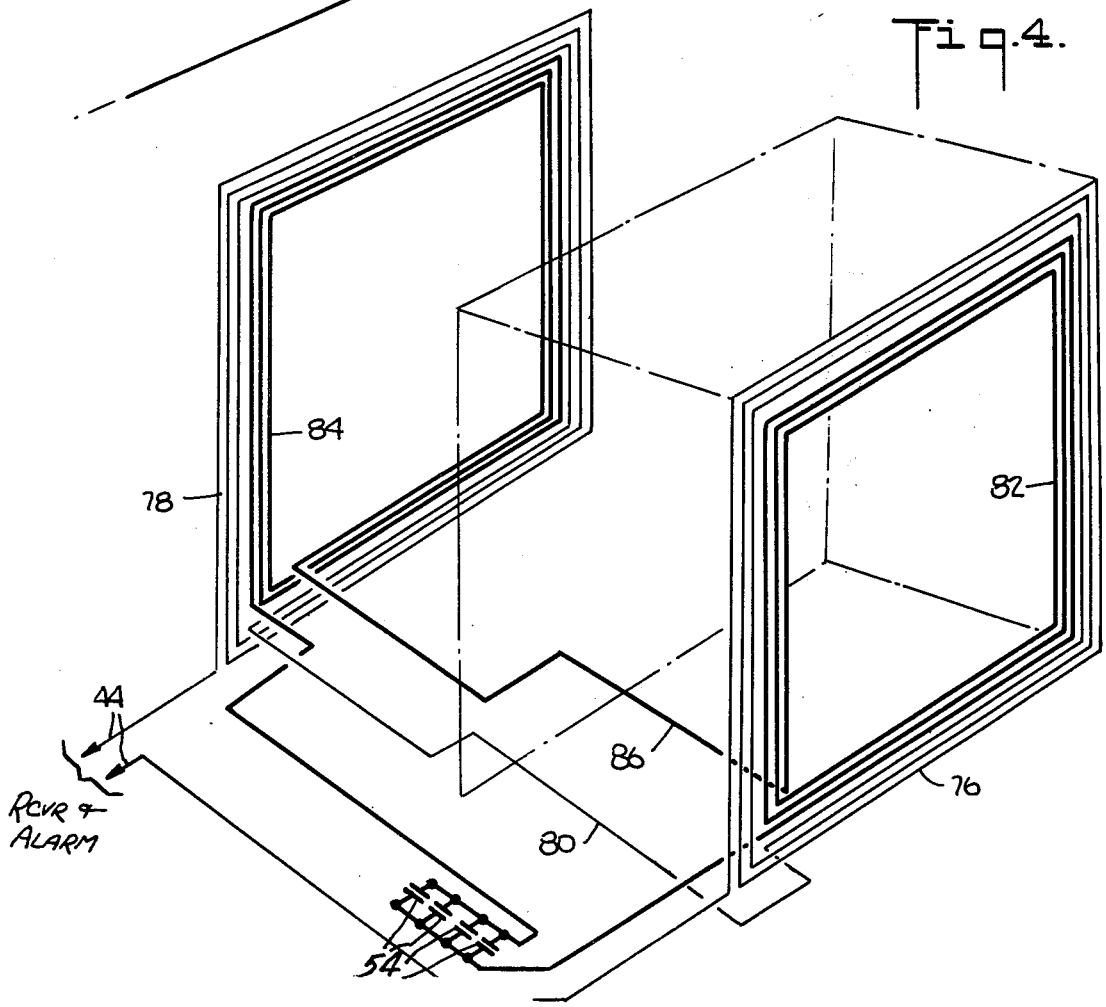
FIG. 4 is an exploded perspective view showing details of the antenna arrangement of FIG. 3.

FIGS. 3 and 4 show an antenna arrangement which is presently preferred for carrying out the present invention.

As shown in FIG. 3 there is provided at opposite sides of the doorway 14, a transmitter antenna panel 60 and a receiver antenna panel 62 which correspond, respectively, to the transmitter and receiving antenna clusters 18 and 20 of FIG. 1. The transmitter antenna panel 60 comprises a rectangular box-like base 64 which extends along the floor and a pair of rectangular open frames 66 and 68 which are diagonally offset but partially intersect each other. The frames themselves are hollow and they provide enclosure and support for transmitter and bias coils. The receiver panel is of similar construction and it also comprises a base 70 on which are mounted diagonally offset and partially intersecting open rectangular frames 72 and 74. The frames 72 and 74 provide enclosure and support for the receiver and parasitic antenna coils.

The bases 64 and 70 on which the frames 66, 68, 72 and 74 are supported may be used to enclose various electrical components including the transmitter, bias, control, parasitic circuit, receiver and alarm portions of the system.

Turning now to the exploded view of FIG. 4 it will be seen that there are provided first and second receiver coils 76 and 78 which correspond to and fit inside the rectangular open frames 72 and 74. The coils 76 and 78 are wound in the opposite direction and they are connected in series, as shown by a crossover line 80. The coils 76 and 78, as indicated, are connected via the leads 44 to the receiver 46 and alarm 47 (not shown in FIG. 4). When the coils 76 and 78 are energized by the presence of alternating electromagnetic fields they produce alternating electrical signals in the leads 44 and supply those signals to the receiver 46. If those signals include components at the particular harmonic frequency to which the receiver is tuned (i.e. the sixth harmonic of the interrogation frequency), the receiver will produce a signal to actuate the alarm 47.

There are also provided, as shown in FIG. 4, first and second parasitic coils 82 and 84 which also correspond to and fit inside the frames 72 and 74. The parasitic coils 82 and 84 are connected in series via a crossover line 86 and they are wound in the same direction. The ends of the coils 82 and 84 are connected via the leads 36 to the parasitic capacitor 54. In this arrangement the parasitic capacitor 54 may be a bank of parallel connected capacitors mounted in the base 70.

The transmitter and bias coils which are carried inside the frames 66 and 68 are not shown in the present drawings. However, these are preferably the same as shown in the aforementioned copending application Ser. No. 715,568. As there described, the antenna coil comprises two coils each contained in a different one of the frames 66 and 68. These coils are wound in the same direction and are connected in series. The bias coil also comprises two coils, each carried in a different one of the frames 66 and 68. The bias coils are also connected in series but they are wound in opposite directions.

In the presently preferred arrangement the frames 66 and 68 of the transmitter antenna panel 60 and the frames 72 and 74 of the receiver panel 62 each extend approximately 30 inches (75 cm.) along each side and they overlap by about 10 inches (25 cm.) in the horizontal direction (dimension "*a*") and about 15 inches (38 cm.) in the vertical direction (dimension "*b*").

The frames 72 and 74 of the receiver antenna panel 62 are of about the same size and arrangement as the frames 66 and 68 of the transmitter antenna panel 60. Also the receiver coils 76 and 78 and the parasitic coils 82 and 84 are of essentially the same configuration, size and arrangement as the interrogation coils. It will also be noted that the parasitic coils are in alignment with the interrogation coils carried in the frames 66 and 68. It will thus be appreciated that maximum inductive coupling is achieved between the transmitter coils and the parasitic coils 82 and 84 across the interrogation zone.

The system of FIGS. 3 and 4 operates in the same manner as the system of FIG. 1; however the particular antenna configuration employed in the arrangement of FIGS. 3 and 4 is preferred because they provide an improved distribution of magnetic field components of different orientation and therefore a better response for all possible exit paths and all possible target configurations.

It has been found that the parasitic coil arrangements herein described make it possible to reduce the amount of electrical current flowing in the transmitter coil by one half that which had been required without the parasitic coil; and yet system performance is greatly improved due to the uniform field distribution which the parasitic coil provides.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A system for detecting the unauthorized passage of specially targeted articles through an interrogation zone, said system comprising an interrogation antenna coil positioned in the vicinity of said interrogation zone, electrical oscillator means connected to said interrogation antenna for energizing same to generate electromagnetic waves in said interrogation zone, a receiver antenna coil also positioned in the vicinity of said interrogation zone, receiver means connected to said receiver antenna coil, said receiver means being operable to produce an alarm signal in response to predetermined electromagnetic disturbances caused by the interaction of a target on a protected article with the electromagnetic waves generated by said interrogation antenna coil, and a parasitic antenna circuit comprising a parasitic antenna coil also positioned in the vicinity of said interrogation zone at a location displaced from said interrogation antenna coil, and capacitor means connected to said parasitic antenna coil to form a resonant circuit therewith, said resonant circuit having a resonant frequency substantially the same as the frequency generated by said electrical oscillator.

2. A system according to claim 1 wherein said parasitic coil is positioned across said interrogation zone from said interrogation antenna coil.

3. A system according to claim 1 wherein said parasitic coil is positioned in substantial alignment with said interrogation antenna coil.

4. A system according to claim 1 wherein said parasitic coil is arranged substantially parallel to said interrogation antenna coil.

5. A system according to claim 1 wherein said parasitic coil is substantially the same size as said interrogation antenna coil.

6. A system according to claim 1 wherein said parasitic coil is inductively coupled to said interrogation antenna coil across said interrogation zone.

7. A system according to claim 1 wherein said resonant circuit is arranged to be energized solely through inductive coupling with said interrogation antenna.

8. A system according to claim 1 wherein said parasitic coil is positioned adjacent said receiver antenna coil.

9. A system according to claim 1 wherein a bias coil is provided adjacent said interrogation antenna coil and is connected to an electrical bias source to provide a continuous magnetic bias to the magnetic field pattern produced by said interrogation antenna.

10. A system according to claim 9 wherein said bias coil is configured to produce a magnetic field pattern in said interrogation zone which is essentially the same as the magnetic field pattern produced by said interrogation antenna.

11. Apparatus for producing an interrogation signal of predetermined frequency in the interrogation zone of a theft detection system, said apparatus comprising an interrogation antenna arranged adjacent said zone, electrical generator means connected to said interrogation antenna for energizing said interrogation antenna at said predetermined frequency, and a parasitic resonant electrical circuit tuned to resonate at said predetermined frequency, said parasitic resonant electrical circuit including a parasitic coil arranged in the vicinity of said interrogation zone spaced apart from said interrogation antenna but inductively coupled thereto across the space between said interrogation antenna and said parasitic coil.

12. Apparatus according to claim 11 wherein said parasitic resonant electrical circuit comprises a parasitic coil connected across a capacitor.

13. Apparatus according to claim 11 wherein said parasitic resonant circuit is energized solely by inductive coupling with said interrogation antenna.

14. Apparatus according to claim 11 wherein said interrogation antenna is of flat, expansive configuration and extends along one side of said interrogation zone and said parasitic coil is also of flat, expansive configuration and is positioned along the opposite side of said interrogation zone parallel to and in alignment with said interrogation antenna.

15. Apparatus according to claim 11 wherein said apparatus further includes magnetic bias means arranged to produce in said interrogation zone a continuous magnetic bias having a configuration and intensity similar in pattern to that of the magnetic field produced by said interrogation antenna.

16. A method for detecting the uanuthorized passage of articles through an interrogation zone said method comprising the step of providing, on articles to be protected, special targets capable of producing predetermined electromagnetic disturbances in response to the incidence thereon of an electromagnetic interrogation field of predetermined frequency, generating from first and second spaced apart sources in the vicinity of said interrogation zone first and second electromagnetic interrogation fields at said predetermined frequency, passing a targeted article through said interrogation zone, monitoring said interrogation zone for the presence of said predetermined electromagnetic disturbances, detecting such disturbances and producing an alarm signal upon such detection, the electromagnetic field from said first source being generated by energizing an interrogation antenna coil from an oscillator coupled thereto and the electromagnetic field from said second source being generated by inductively coupling a resonant electrical circuit, tuned to said predetermined frequency, to said interrogation antenna coil.

17. A method according to claim 16 wherein said second electromagnetic field is generated at a phase relationship to said first electromagnetic field of substantially 90°.

18. A method according to claim 16 wherein said resonant electrical circuit is electrically energized solely by inductive coupling to said interrogation antenna coil.

19. A method according to claim 16 wherein a continuous magnetic bias is provided which has an intensity and configuration corresponding to the intensity and configuration of the magnetic field produced by said interrogation antenna.

20. A method of producing an electromagnetic interrogation signal of predetermined frequency in an interrogation zone through which specially targeted articles pass, said method comprising the steps of electrically energizing an interrogation antenna coil in the vicinity of said interrogation zone at said predetermined frequency to produce primary electromagnetic waves in said zone, inductively coupling said interrogation antenna coil to a resonant electrical circuit tuned to said predetermined frequency and positioned in the vicinity of said interrogation zone and emitting secondary electromagnetic waves from said resonant electrical circuit.

21. A method according to claim 20 wherein a continuous magnetic bias is provided which has an intensity and configuration corresponding to the intensity and configuration of the magnetic field produced by said interrogation antenna.

* * * * *